US005217143A

United States Patent [19]

Aitken

[11] Patent Number: 5,217,143

[45] Date of Patent: Jun. 8, 1993

[54] ACTUATING DEVICE FOR A SELF-CONTAINED FLUID DISPENSER IN A BANGLE

[75] Inventor: Alexander G. Aitken, Inglewood, Australia

[73] Assignee: Body Products Pty. Limited, Perth, Australia

[21] Appl. No.: 742,748

[22] Filed: Aug. 9, 1991

[51] Int. Cl.[5] ..... B67D 1/07

[52] U.S. Cl. ..... 222/78; 222/135; 222/175; 222/192; 222/321; 206/823; 63/DIG. 2; 239/154; 239/211

[58] Field of Search ..... 222/78, 135, 175, 192, 222/321, 383, 385, 382, 402.13, 402.15, 505, 509; 239/153, 154, 211, 289; 63/3, 7, 8, DIG. 2; 206/37, 823

[56] References Cited

U.S. PATENT DOCUMENTS

| | | | |
|---|---|---|---|
| 1,673,617 | 6/1928 | Clark | 63/DIG. 2 X |
| 1,780,407 | 11/1930 | Smith . | |
| 2,180,980 | 11/1939 | Fassnacht et al. . | |
| 2,235,350 | 3/1941 | Anderson . | |
| 2,522,852 | 9/1950 | Apps . | |
| 2,751,764 | 6/1956 | Hudes et al. | 63/DIG. 2 |
| 3,270,525 | 9/1966 | Sellers | 63/DIG. 2 |
| 3,534,889 | 10/1970 | O'Donnell | 222/402.13 |
| 3,952,917 | 4/1976 | Gause | 239/211 X |
| 4,058,237 | 11/1977 | Luke | 222/78 |
| 4,241,850 | 12/1980 | Speer . | |
| 4,674,299 | 6/1987 | Azar . | |
| 4,736,876 | 4/1988 | Kriss | 222/175 X |
| 4,753,086 | 6/1988 | Schmidt . | |
| 4,768,688 | 9/1988 | Harrigan | 222/175 X |
| 4,972,684 | 11/1990 | Aitken | 63/8 |

FOREIGN PATENT DOCUMENTS

| | | | |
|---|---|---|---|
| 573347 | 3/1924 | France . | |
| 650144 | 9/1928 | France . | |
| 788465 | 7/1935 | France . | |
| 16564 | of 1887 | United Kingdom | 63/DIG. 2 |
| 204657 | 7/1923 | United Kingdom | 63/DIG. 2 |
| 466988 | 6/1936 | United Kingdom . | |

*Primary Examiner*—Gregory L. Huson

*Attorney, Agent, or Firm*—Ross, Howison, Clapp & Korn

[57] ABSTRACT

An actuator mechanism for a bangle that includes a reservoir (24) with associated nozzle (32) having an outlet (33). The reservoir (24) is disposed in one portion of a bangle (10) that is semi-circular in shape. The nozzle (32) is disposed in a slot (18) and then an actuator mechanism comprised of two portions (20) is (22) assembled in the slot. The actuator mechanism is operable to slide downward such that the rear portion (22) of the actuator mechanism contacts the upper portion of the nozzle (32). Depression of the nozzle (32) results in fluid being expelled from an outlet (33) through the slot (18). The outer portion (10) can be changed to alter the design, etc.

3 Claims, 3 Drawing Sheets

ACTUATING DEVICE FOR A SELF-CONTAINED FLUID DISPENSER IN A BANGLE

TECHNICAL FIELD OF THE INVENTION

The present invention pertains in general to bangles, and more particularly, to an actuator mechanism for dispensing fluid from an integral fluid dispenser in the bangle.

BACKGROUND OF THE INVENTION

A number of bangles have been disclosed in the past that utilize an internal reservoir of fluid. They are described in U.S. Pat. No. 4,972,684, issued Nov. 27, 1990. In general, the fluid is contained in a removable bottle that is disposed in a cavity in the bangle and then a spray nozzle disposed on the end thereof. This is a pump type nozzle that is manually actuated in a reciprocal motion. An orifice is utilized to allow the finger to reach inside and coact with the spray nozzle itself. This provides some disadvantage in that a large orifice is provided in the side of the bangle in order to access the top of the spray nozzle. Further, this is very unwieldy. Therefore, there exists a need for an improved actuating mechanism for this type of bangle.

SUMMARY OF THE INVENTION

The present invention disclosed and claimed herein comprises an arcuate bangle. The bangle includes at least one semi-circular member having a cavity disposed therein. A fluid reservoir is provided that is removably disposed within the cavity. A spray nozzle is disposed on the end of the reservoir and is operable to be interfaced with the interior of the reservoir to expel the contents of the reservoir. The nozzle has an outlet that expels outward at a substantially perpendicular angle to the exterior surface of the bangle. A slot is provided on the exterior surface of the semi-circular member and extending therethrough, and interfaced with the nozzle. The outlet is directed outward through the slot when the nozzle is reciprocated and for all positions of reciprocation thereof. An actuator is provided for reciprocating within the slot, which actuator has a first interior portion and a second exterior portion. The first portion is operable to be disposed on the rear side of the slot and is guided along the slot and having a protrusion extending rearward of the slot. The protrusion is operable to contact the nozzle. The second portion has a design associated therewith and is removably attached to the first portion. This exterior portion is accessible for manipulation by a finger to move the first portion within the slot.

BRIEF DESCRIPTION OF THE DRAWINGS

For a more complete understanding of the present invention and the advantages thereof, reference is now made to the following description taken in conjunction with the accompanying Drawings in which.

DETAILED DESCRIPTION OF THE INVENTION

Figure 1:
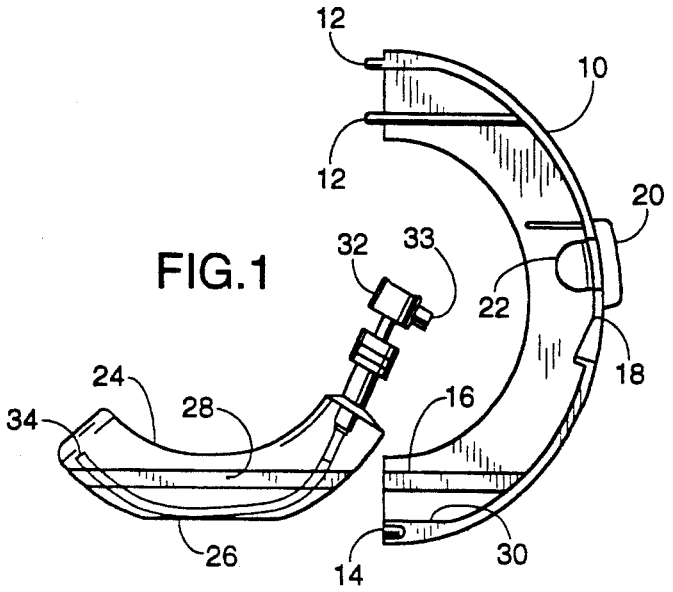
FIG. 1 illustrates a side view of one half of the bangle illustrating the insertion of the reservoir therein.
Figure 1A:
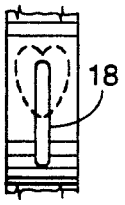

Referring now to FIG. 1, there is illustrated a side view of one half of a bangle, referred to by a reference numeral 10. The section 10 is semi-circular in shape and has two interlocking pins 12 disposed on one side and extended tangentially with respect to the curvature thereof, and holes 14 on the opposite side thereof which, as will be described hereinbelow, are utilized to mate with the opposite half. A raised rail 16 is disposed on one end of the member 10 and a slot 18 is disposed in substantially the center thereof and along the outer surface. A detail of the slot 18 is illustrated in FIG. 1A. An actuating mechanism comprised of an outer portion 20 and an inner portion 22 is disposed within the slot 18 and is operable to reciprocate therein. The slot 18 runs along the peripheral direction thereof for the purpose of actuating the spray device, as will be described hereinbelow.

A reservoir 24 is provided that is arcuate in shape. The outer surface thereof has a flat 26 disposed thereon and a recess grove 28 is disposed on either side of the reservoir 24. The reservoir 24 is shaped conformably with respect to the member 10, such that when it is disposed against the inner surface of the member 10, the outer surface of the reservoir 24 conforms thereto. A coordinating flat 30 on the inner surface of the member 10 is operable to receive the flat 26 on the reservoir 24. The groove 20 is operable to slide over the rail 16, such that the reservoir 24 will not rotate along the inner surface of the member 10.

A pump nozzle 32 is disposed in one end of the reservoir 24 which extends downward with a tube 34 into the interior of the reservoir 24. The nozzle 32 has an outlet 33 associated therewith that is directed outward at a substantially perpendicular angle thereto. The compression of the nozzle 32 results in the expulsion of fluid therein from nozzle 33. Although illustrated as a manually actuated pump, it should be understood that a pressurized reservoir 24 could be utilized, which reservoir could be pressurized with a gas such as butane, carbon dioxide, etc.

Figure 2:
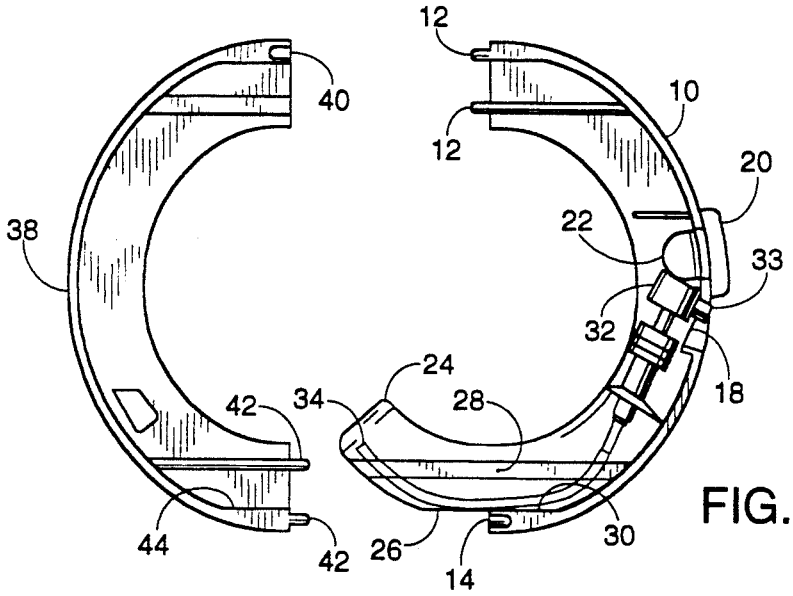
FIG. 2 illustrates the assembly of a second half with the first half and the assembled reservoir.

When the reservoir 24 is disposed in the member 10 such that the recess 28 is interfaced with the rail 16, the nozzle 32 is disposed adjacent to slot 18 such that the outlet 33 is directed outward through the slot 18. Further, the upper and most distal end of the nozzle 32 is disposed against the inner portion 22 of the actuator 26 such that it forces the actuator up against the extreme end of the slot 18. This is illustrated in FIG. 2.

After the reservoir 24 is disposed within the member 10, a second half member 38, essentially identical to the member 10 is disposed against the pins 12 and the holes 14. The member 38 is circular in shape and has a plurality of holes 40 disposed on one end and a plurality of pins 42 disposed on the opposite end. The holes 40 are operable to interface with the pins 12 and the pins 42 are operable to interface with the holes 14. The holes 14 are essentially square in shape and the pins 42 are substantially round in shape such that when the pins 42 are disposed within the holes 14, a very tight friction fit results. A flat 44 is provided that interfaces with the flat 26 of the reservoir 24.

Figure 3:
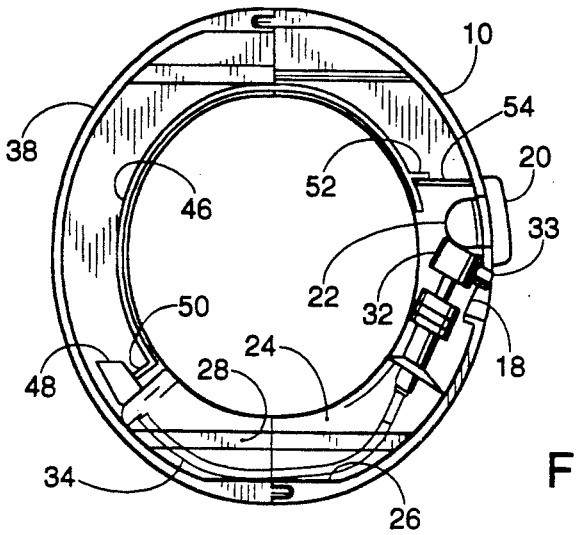
FIG. 3 illustrates the assembled unit.

FIG. 3 illustrates the assembled bangle which, after assembly of the two members 10 and 38 with the reservoir 24 disposed therein, an inner cover 46 is disposed around the inner periphery thereof. The cover has an angled stop member 50 disposed on one end that is operable to rest against the end of the reservoir 24 and an angled member 52 that is operable to rest against a support member 54 in the member 10. The portion of the bottle 24 disposed inward acts as an inner surface which, when combined with the cover 46 provides substantially full coverage of the interior surface thereof. The reservoir 24 is also held in place with a stop 48 that is disposed in the member 38 that contacts the end of the reservoir 24 to maintain it in a relatively secure and non-vibrating position. The cover 46 defines a cavity for storing items in the bangle.

In operation, the actuator is reciprocated down in the slot 18 in order that the inner portion 22 contacts the upper end of the end of the nozzle 32 to allow it to be depressed in a plunger-like motion to force fluid out of the outlet 33. A certain amount of reciprocal motion is required in the slot 18 to allow the nozzle 32 to reciprocate downward. It can be seen that the actuator that is comprised of the two portions, the outer portion 20 and the inner portion 22, allows for alternating the outer portion 20 for design purposes. As such, different designs can be accommodated, and implemented by disassembling the bangle and inserting another outer portion 22 to provide a different design.

Figure 4:
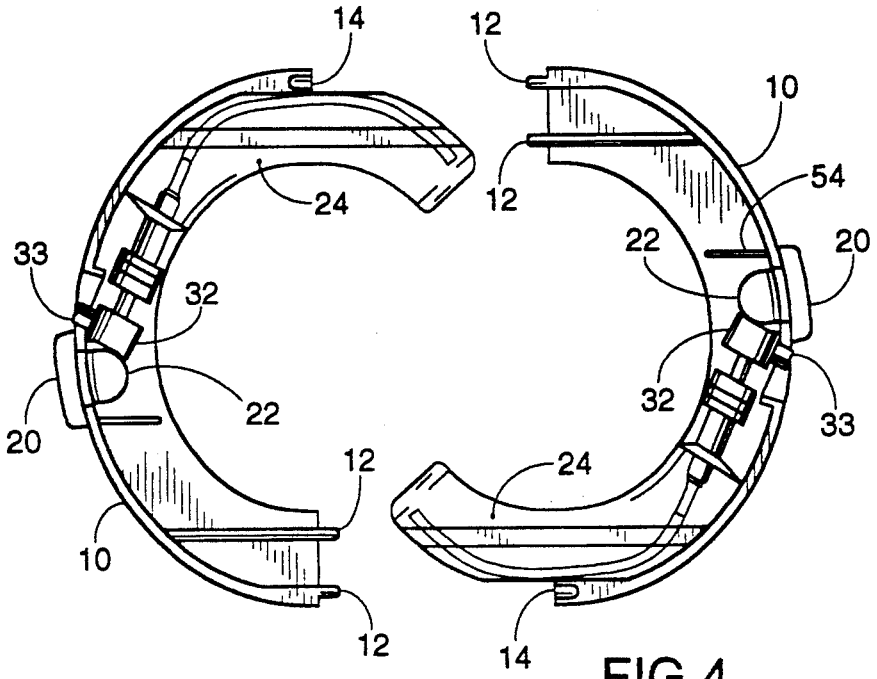
FIGS. 4–5 illustrate an alternate embodiment of the invention for accommodating two separate reservoirs.
Figure 5:
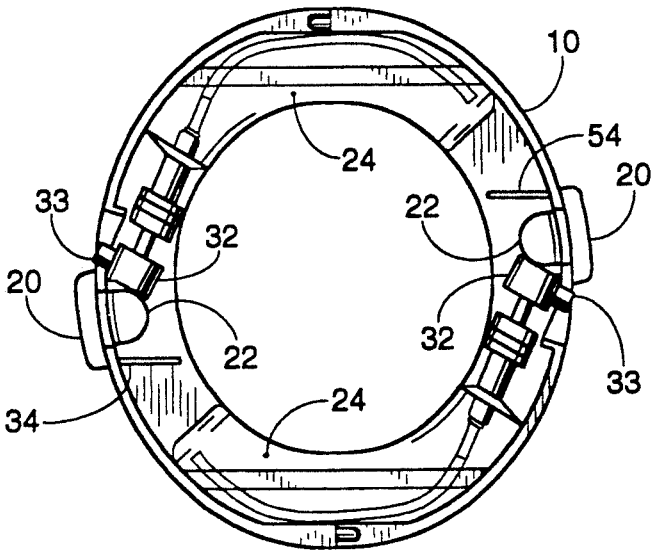

Referring now to FIGS. 4–5, there is illustrated an alternate embodiment wherein two of the assemblies in FIG. 1 are mated together. This allows for two reservoirs to be provided on opposite sides. In this manner, the assembly requires that the pins 12 on both halves, or members 10, be mated with the corresponding holes 14 on the opposite end, with the respective members 10 disposed at 180°.

Figure 6A:
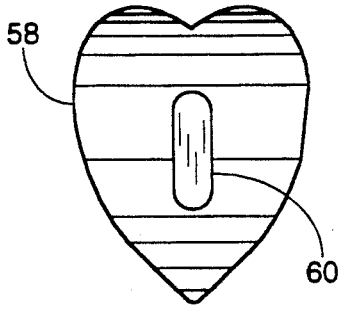
FIGS. 6A–6D illustrate a detail of the exterior portion of the actuating mechanism.
Figure 6B:
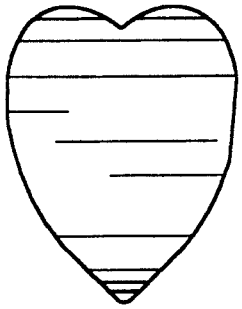
Figure 6C:
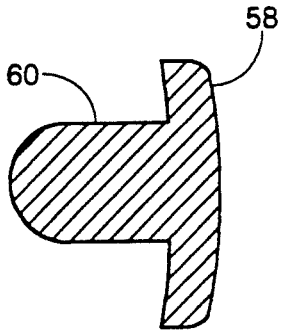
Figure 6D:
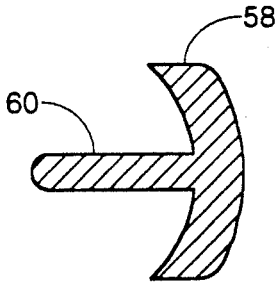
Figure 7A:
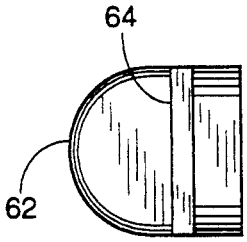
FIGS. 7A–7D illustrate the back portion of the actuating mechanism that contacts the top of the pump nozzle on the reservoir.
Figure 7B:
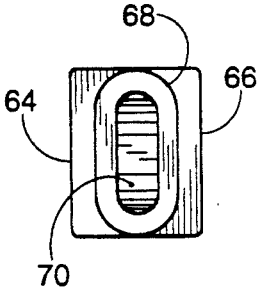
Figure 7C:
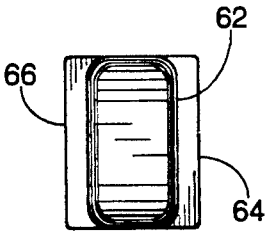
Figure 7D:
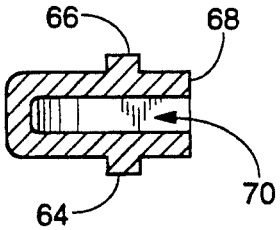

Referring now FIGS. 6A–6D, there is illustrated front, back, side and bottom views of the outer portion 20 of the actuator. In general, FIG. 6A illustrates a back view of the outer portion 20 which is comprised of a curved surface 58 and a protruding member 60 that is disposed substantially perpendicular to the plane of the curved member 58. It can be seen from FIG. 6B that the shape of the front surface 58 is shaped like a heart. However, it could be shaped in a number of different configurations to realize any type of design, etc. The curvature of the surface 58 is such that it conforms both to the longitudinal circumferential shape of the member 10, and also to the lateral shape thereof, taken along the cross-section of the member 10.

Referring now to FIGS. 7A–7D, there are illustrated front, back, side and cross-sectional views of the rear portion 22 of the actuator mechanism. The rear portion 22 is comprised generally of a body 62 that has two rails 64 and 66 disposed on either side thereof. The rails 64 and 66 are operable to provide a surface on which the body 62 can slide on the inner side of the member 10 and prevent the body 62 from pushing through the slot 18. A protrusion 68 extends upwards from the rails 64 and 66 and has a longitudinal cavity 70 disposed therein. The protrusion 68 extends upward into the slot 18 and the cavity 70 extends backwards from the opening in the protrusion 68 into the body 62 and extends on the diametrically opposite side of the rails 64 and 66.

During assembly, the rear portion 22 has the protrusion 68 disposed through the slot 18. The protruding member 60 on the outer portion 20 is then inserted into the cavity 70 which results in a friction fit. The rear portion of the body 62 then provides a surface that can contact the most distal surface of the nozzle 32. It can be seen that the rear portion of the body 62 is curved such that it can rotate relative to the substantially flat surface of the nozzle 32 when the nozzle 32 is depressed and reciprocates downward. This allows for non-restrictive movement thereof.

In summary, there has been provided an actuator mechanism for a spray nozzle on an embedded reservoir in a wrist bangle. A slot is provided in the outer surface of the bangle which is operable to receive the outlet of the spray nozzle. An actuator mechanism is operable to reciprocate within the slot and push downward on the spray nozzle. This actuator nozzle is comprised of two portions, a first design portion disposed on the outside of both the slot and the bangle and a rear portion that attaches thereto on the opposite side of the slot. The two portions, when put together, provide a reciprocating member which has a replaceable outside portion to change the design, etc. When depressed, the rear portion depresses the nozzle and associated plunger in to expel fluid from the reservoir.

Although the preferred embodiment has been described in detail, it should be understood that various changes, substitutions and alterations can be made therein without departing from the spirit and scope of the invention as defined by the appended claims.

What is claimed is:

1. An arcuate bangle comprising:

at least one semi-circular member having a cavity disposed therein that is operable to form a portion of an arcuate bangle;

a fluid reservoir removably disposed within said cavity;

a spray nozzle disposed on one end of said reservoir and operable to be disposed proximate to the interior of said reservoir and to expel the contents of said reservoir when reciprocated relative to said reservoir, said nozzle having an outlet that expels outward at a substantially perpendicular angle to the exterior surface of the bangle;

a slot on the exterior of said semi-circular member and interfaced with said nozzle such that said outlet is directed outward through said slot when said nozzle is reciprocated and for all positions of reciprocation thereof;

an actuator separate from said fluid reservoir and said nozzle for reciprocating said nozzle, said actuator comprising:

a first portion for reciprocating within said slot, said first portion having a protrusion associated therewith extending to the rear of said slot and in contact with said nozzle such that reciprocation downward in said slot of said first portion results in reciprocation of said nozzle, and a removable exterior portion having a design associated therewith for being attached to said first portion and accessible for manipulation thereof by a finger from the exterior of the bangle to move said first portion within said slot in a reciprocating motion.

2. The bangle of claim 1 wherein the protrusion of said first portion has a radius associated therewith to allow the nozzle to move along said radius as it is reciprocated.

3. An arcuate bangle comprising:

at least one semi-circular member having a cavity disposed therein that is operable to form a portion of an arcuate bangle;

a fluid reservoir removably disposed within said cavity;

a spray nozzle disposed on one end of said reservoir and operable to be disposed proximate to the interior of said reservoir and to expel the contents of said reservoir when reciprocated relative to said reservoir, said nozzle having an outlet that expels outward at a substantially perpendicular angle to the exterior surface of the bangle;

a slot on the exterior of said semi-circular member and interfaced with said nozzle such that said outlet is directed outward through said slot when said nozzle is reciprocated and for all positions of reciprocation thereof; and an actuator separate from said fluid reservoir and said nozzle for reciprocating said nozzle, said actuator comprising:

a first portion for reciprocating within said slot, said first portion having a protrusion associated therewith extending to the rear of said slot and in contact with said nozzle such that reciprocation downward in said slot of said first portion results in reciprocation of said nozzle, a removable exterior portion having a design associated therewith for being attached to said first portion and accessible for manipulation thereof by a finger from the exterior of the bangle to move said first portion within said slot in a reciprocating motion, said first portion comprised of a body having a recess disposed therein with an opening, the exterior rim of said opening extending substantially within said slot, said body having a shoulder member disposed about the periphery of said body for contacting the portion of said semicircular member on either side of said slot on the rear surface thereof to prevent said body from moving through said slot, the extended portion of said body forming the opening for said recess being disposed within said slot to act as a guide therefor, and said removable exterior portion having a first surface for being disposed on the exterior of said semicircular member and being wider than said slot and a protrusion on the rear surface of said exterior portion extending backward and operable to be securely disposed within said recess such that the fit is a friction fit and said exterior portion can be removed for replacement with a different design.

* * * * *